US006209372B1

(12) United States Patent
Freeman

(10) Patent No.: US 6,209,372 B1
(45) Date of Patent: Apr. 3, 2001

(54) INTERNAL HYDROFORMED REINFORCEMENTS

(75) Inventor: Richard Benjamin Freeman, Oxford, MI (US)

(73) Assignee: The Budd Company, Troy, MI (US)

( * ) Notice: Subject to any disclaimer, the term of this patent is extended or adjusted under 35 U.S.C. 154(b) by 0 days.

(21) Appl. No.: 09/399,559

(22) Filed: Sep. 20, 1999

(51) Int. Cl.[7] ..... B21D 26/02

(52) U.S. Cl. ..... 72/58; 29/421.1

(58) Field of Search ..... 72/57, 58, 61, 72/62; 29/421.1

(56) References Cited

U.S. PATENT DOCUMENTS

| | | |
|---|---|---|
| 1,000,574 | 9/1911 | Bauroth . |
| 1,886,831 | 11/1932 | Murray . |
| 1,926,353 | 9/1933 | Spatta . |
| 2,203,868 | 6/1940 | Gray et al. . |
| 2,205,893 | 6/1940 | Unger . |
| 3,273,916 | 9/1966 | Tillery . |
| 3,350,905 | 11/1967 | Ogura et al. . |
| 3,358,489 | 12/1967 | Hutchins . |
| 3,564,886 | 2/1971 | Nakamura . |
| 3,583,188 | 6/1971 | Nakamura . |
| 3,630,056 | 12/1971 | Cuq . |
| 3,672,194 | 6/1972 | Martin . |
| 3,685,327 | 11/1972 | Nakamura . |
| 3,798,943 | 3/1974 | Benteler et al. . |
| 3,914,969 | 10/1975 | Banks . |
| 4,179,910 | 12/1979 | Mazier . |
| 4,237,713 | 12/1980 | Benteler et al. . |
| 4,267,718 | 5/1981 | Benteler et al. . |
| 4,317,348 | 3/1982 | Halene et al. . |
| 4,319,471 | 3/1982 | Benteler et al. . |
| 4,354,369 | 10/1982 | Hamilton . |
| 4,437,326 | 3/1984 | Carlson . |
| 4,567,746 | 2/1986 | Cudini . |
| 4,595,077 | 6/1986 | Buttgereit . |
| 4,619,129 | 10/1986 | Petkov et al. . |
| 4,751,835 | 6/1988 | Galaniuk et al. . |
| 4,761,982 | 8/1988 | Snyder . |
| 4,763,503 | 9/1988 | Hughes et al. . |
| 4,782,679 | 11/1988 | Bogel . |
| 4,901,552 | 2/1990 | Ginty et al. . |
| 4,936,128 | 6/1990 | Story et al. . |
| 4,951,492 | 8/1990 | Vogt . |

(List continued on next page.)

FOREIGN PATENT DOCUMENTS

| | | |
|---|---|---|
| 1055236 | 5/1979 | (CA) . |
| 610114 | 3/1935 | (DE) . |
| 195 30 055 A1 | 2/1997 | (DE) . |

(List continued on next page.)

OTHER PUBLICATIONS

Sawyer, Christopher A., "Hydro–Forming is Hot", *Automotive Industries*, (Jun. 1991), pp. 49, 51.

"Hyprotec Delivery to North America completed", *Hyprotec—News*, (1995), pp. 1–4.

(List continued on next page.)

*Primary Examiner*—David Jones
(74) *Attorney, Agent, or Firm*—Harness, Dickey & Pierce, P.L.C.

(57) ABSTRACT

A hydroformed member having internal reinforcements and method of manufacturing the same. The method includes the steps of providing a die having a tooling cavity and a pair of opposing rams disposed in the tooling cavity. A tubular member is enclosed within the tooling cavity. The pair of opposing rams are then driven against opposing sides of the tubular member to form a pair of opposing indentations therein. While the rams remain in place, hydraulic fluid pressure is then applied within the tubular member causing the walls of the tubular member to closely conform to the shape of the tooling cavity and the pair of opposing rams.

25 Claims, 2 Drawing Sheets

U.S. PATENT DOCUMENTS

| | | | |
|---|---|---|---|
| 5,107,693 | | 4/1992 | Olszewski et al. . |
| 5,157,969 | | 10/1992 | Roper . |
| 5,170,557 | | 12/1992 | Rigsby . |
| 5,205,187 | | 4/1993 | Ebbinghaus . |
| 5,233,854 | | 8/1993 | Bowman et al. . |
| 5,233,856 | | 8/1993 | Shimanovski et al. . |
| 5,239,852 | | 8/1993 | Roper . |
| 5,259,268 | | 11/1993 | Ebbinghaus et al. . |
| 5,279,142 | | 1/1994 | Kaiser . |
| 5,303,570 | | 4/1994 | Kaiser . |
| 5,320,331 | | 6/1994 | Hellman, Sr. . |
| 5,321,964 | | 6/1994 | Shimanovski et al. . |
| 5,333,775 | | 8/1994 | Bruggemann et al. . |
| 5,339,667 | | 8/1994 | Shah et al. . |
| 5,353,618 | | 10/1994 | Roper et al. . |
| 5,363,544 | | 11/1994 | Wells et al. . |
| 5,372,026 | | 12/1994 | Roper . |
| 5,372,027 | | 12/1994 | Roper et al. . |
| 5,398,533 | | 3/1995 | Shimanovski et al. . |
| 5,415,021 | | 5/1995 | Folmer . |
| 5,419,791 | | 5/1995 | Folmer . |
| 5,431,326 | | 7/1995 | Ni et al. . |
| 5,435,163 | | 7/1995 | Schaefer . |
| 5,435,205 | | 7/1995 | Seksaria et al. . |
| 5,445,001 | | 8/1995 | Snavley . |
| 5,460,026 | | 10/1995 | Schäfer . |
| 5,460,773 | | 10/1995 | Fritz et al. . |
| 5,466,146 | | 11/1995 | Fritz et al. . |
| 5,471,857 | | 12/1995 | Dickerson . |
| 5,475,911 | | 12/1995 | Wells et al. . |
| 5,481,892 | | 1/1996 | Roper et al. . |
| 5,485,737 | | 1/1996 | Dickerson . |
| 5,533,372 | | 7/1996 | Roper et al. . |
| 5,545,026 | | 8/1996 | Fritz et al. . |
| 5,553,474 | | 9/1996 | Nokajima et al. . |
| 5,557,961 | | 9/1996 | Ni et al. . |
| 5,561,902 | | 10/1996 | Jacobs et al. . |
| 5,564,785 | | 10/1996 | Schultz et al. . |
| 5,582,052 | | 12/1996 | Rigsby . |
| 5,600,983 | | 2/1997 | Rigsby . |
| 5,630,334 | | 5/1997 | Ash . |
| 5,632,508 | | 5/1997 | Jacobs et al. . |
| 5,641,176 | | 6/1997 | Alatalo . |
| 5,662,349 | | 9/1997 | Hasshi et al. . |
| 5,666,840 | | 9/1997 | Shah et al. . |
| 5,673,470 | | 10/1997 | Dehlinger et al. . |
| 5,673,929 | | 10/1997 | Alatalo . |
| 5,715,718 | | 2/1998 | Rigsby et al. . |
| 5,718,048 | | 2/1998 | Horton et al. . |
| 5,720,092 | | 2/1998 | Ni et al. . |
| 5,735,156 | * | 4/1998 | Yoshitomi et al. ..... 72/58 |
| 5,775,153 | | 7/1998 | Rigsby et al. . |
| 5,799,524 | | 9/1998 | Schäfer . |
| 5,813,266 | | 9/1998 | Ash . |
| 5,815,901 | | 10/1998 | Mason et al. . |
| 5,816,089 | | 10/1998 | Marando . |
| 5,836,065 | | 11/1998 | Dehlinger et al. . |
| 5,845,382 | | 12/1998 | Schultz et al. . |
| 5,855,394 | | 1/1999 | Horton et al. . |
| 5,857,897 | | 1/1999 | Krcek et al. . |
| 5,862,877 | | 1/1999 | Horton et al. . |
| 5,882,039 | | 3/1999 | Beckman et al. . |
| 5,884,722 | | 3/1999 | Durand et al. . |
| 5,899,498 | | 5/1999 | Horton . |
| 5,918,494 | | 7/1999 | Kojima et al. . |
| 5,927,120 | | 7/1999 | Marando . |
| 5,932,167 | | 8/1999 | Fritz et al. . |
| 5,941,112 | | 8/1999 | Ghiran et al. . |
| 5,953,945 | | 9/1999 | Horton . |
| 5,970,767 | * | 10/1999 | Hartman et al. ..... 72/62 |
| 5,974,846 | | 11/1999 | Ash . |
| 5,979,201 | | 11/1999 | Horton et al. . |
| 5,987,950 | | 11/1999 | Horton . |
| 5,992,197 | | 11/1999 | Freeman et al. . |
| 6,006,568 | | 12/1999 | Bihrer . |
| 6,032,501 | | 3/2000 | Bihrer . |

FOREIGN PATENT DOCUMENTS

| | | |
|---|---|---|
| 197 20 133 A1 | 11/1997 | (DE) . |
| 0 036 365 A1 | 9/1981 | (EP) . |
| 0 372 360 A2 | 6/1990 | (EP) . |
| 0 588 528 A1 | 3/1994 | (EP) . |
| 0 650 860 A1 | 10/1994 | (EP) . |
| 0 683 305 A2 | 11/1995 | (EP) . |
| 0 686 440 A1 | 12/1995 | (EP) . |
| 0 742 057 A2 | 11/1996 | (EP) . |
| 0 758 565 A1 | 2/1997 | (EP) . |
| 0 770 435 A1 | 5/1997 | (EP) . |
| 0 742 057 A3 | 7/1997 | (EP) . |
| 0 913 277 A1 | 5/1999 | (EP) . |
| 1083269 | 9/1967 | (GB) . |
| 40 17 072 A1 | 11/1991 | (GB) . |
| 2 282 580 | 4/1995 | (GB) . |
| 2 291 382 | 1/1996 | (GB) . |
| 2 304 613 | 3/1997 | (GB) . |
| 37-9318 | 7/1962 | (JP) . |
| 38-19434 | 9/1963 | (JP) . |
| 44-21969 | 9/1969 | (JP) . |
| 56-17132 | 2/1981 | (JP) . |
| 61-49735 | 3/1986 | (JP) . |
| 385146 | 3/1965 | (SE) . |
| WO 98/08633 | 3/1998 | (WO) . |
| WO 98/46382 | 10/1998 | (WO) . |
| WO 99/03616 | 1/1999 | (WO) . |
| WO 99/17894 | 4/1999 | (WO) . |
| WO 99/20516 | 4/1999 | (WO) . |

OTHER PUBLICATIONS

"The Modular IHP Plant System", *H & BHyprotec Techologie oHG*, (Jan. 1995).

Christensen, William L. "Hydroforming of Tubular Sections", *MetalForming* , (Oct. 1995), pp. 36–38, 40, 43.

Pro. Dr.–Ing. Kurt Lange, a German publication entitled *Industrie–Anzeiger,* (May 10, 1996), pp. 107–110; (Jun. 17, 1996) pp. 137–140 (translation unavailable).

Murray Mason, "Hydroform Tubes for Automotive Body Structure Applications", *SAE Technical Paper Series 930575*, Mar. 1–5, 1993.

J. Neiland Pennington, "Hydroforming: More part for less cost in GM luxury/performance cars", *Modern Metals*, Oct. 1994.

Fritz Dohmann and Fredrich Klaas, "Methods of tube forming", *Strips Sheets Tubes,* (Mar. 1986), pp. 39–41.

* cited by examiner

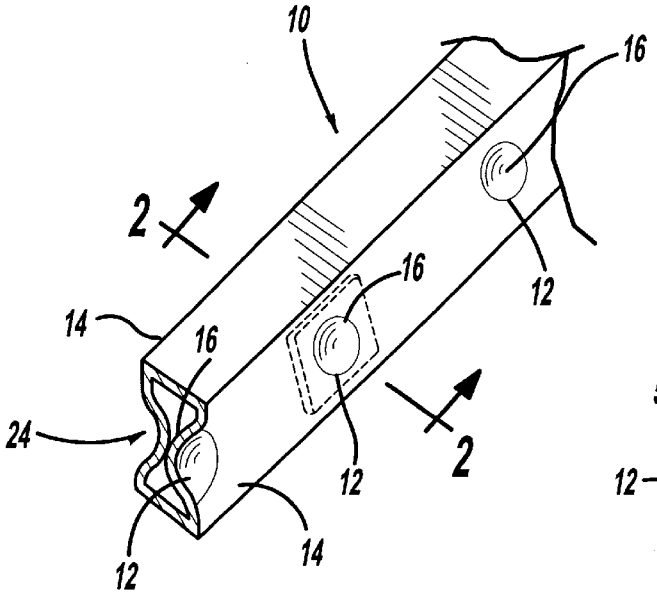
Figure - 1
Figure - 2
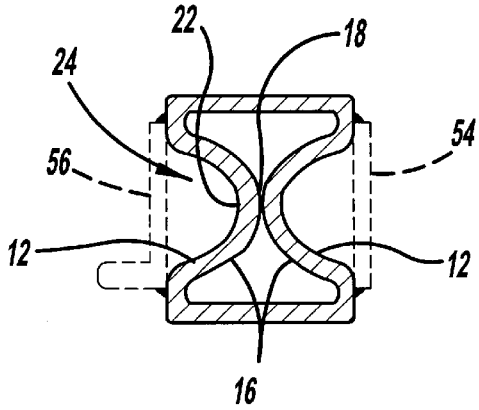
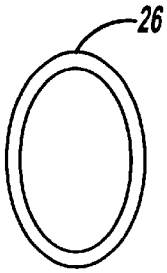
Figure - 3
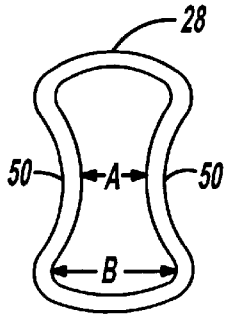
Figure - 4
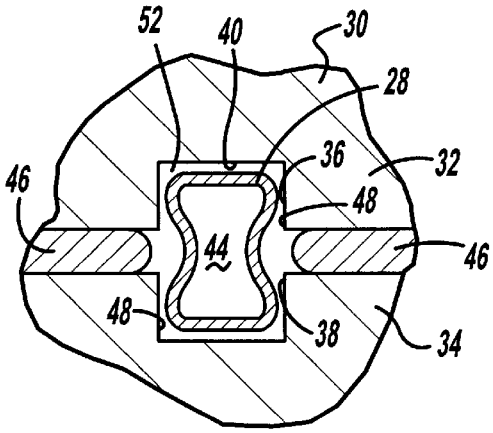
Figure - 5
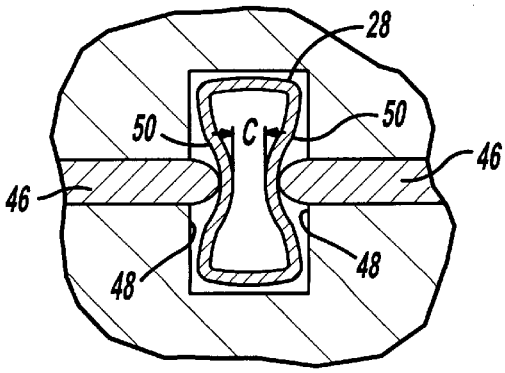
Figure - 6

INTERNAL HYDROFORMED REINFORCEMENTS

FIELD OF THE INVENTION

The present invention relates to a hydroformed structural member and, more particularly, relates to a hydroformed structural member having internal hydroformed reinforcements and a method of making the same.

BACKGROUND OF THE INVENTION

It is well known, in the prior art, that the structural or mechanical characteristics of a support member may be improved with the addition of internal reinforcements. This practice is common in the use of stamp-formed members, wherein internal supports are secured, typically by welding, to the stamp-formed member to provide additional localized loading capabilities. However, with the increased popularity and dimensional accuracy of hydroforming, there has been a growing trend to provide additional sectional stiffness as needed for localized loading.

By way of review, hydroforming is essentially the process of deforming a tubular member to a desired complex tubular shape. To this end, the tubular member is placed between a pair of dies having cavities which define the desired resultant shape of the tube. The ends of the tubular member are accessible through the die and a seal is connected to the ends of the tubular member. Pressurized fluid is then injected into the ends of the tubular member, thereby forcing the tubular member to expand and conform to the shape defined by the die cavity.

To provide additional sectional stiffness in hydroformed members, attempts have been made to form hydroformed members having varying wall thickness. This is typically accomplished by welding multiple tubular sections having varying wall thickness together to form a tubular blank. The tubular blank is then hydroformed to produce a member having additional localized stiffness. However, this method is relatively time-consuming and requires additional process steps of assembling and welding the tubular blanks. Lastly, the additional processing steps may further limit the ability to mass produce such items cost effectively.

Accordingly, there exists a need in the relevant art to provide a method of simply and conveniently forming a hydroformed structural member capable of providing additional sectional stiffness while, simultaneously, minimizing the necessary process steps. Furthermore, there exists a need in the relevant art to provide a method of forming a member having internal hydroformed reinforcements. Still further, there exists a need in the relevant art to provide a hydroformed member having internal reinforcements.

SUMMARY OF THE INVENTION

In accordance with the broad teachings of this invention, a hydroformed member having internal reinforcements is provided having an advantageous construction and method of manufacturing the same. The method comprises the steps of providing a die having a tooling cavity and a pair of opposing rams disposed in the tooling cavity. A tubular member is enclosed within the tooling cavity. The pair of opposing rams are then driven against opposing sides of the tubular member to form a pair of opposing indentations therein. While the rams remain in place, hydraulic fluid pressure is then applied within the tubular member causing the walls of the tubular member to closely conform to the shape of the tooling cavity and the pair of opposing rams.

The present invention enables internal reinforcements to be hydroformed within a member to provide improved crash energy management and/or improved load bearing characteristics. The present invention is accomplished in a minimum number of process step, thereby minimizing manufacturing time and complexity and further reducing manufacturing costs.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1 is a perspective view of a hydroformed structural member having internal hydroformed reinforcements according to the present invention;

FIG. 2 is a cross sectional view of FIG. 1, taken along line 2—2;

FIGS. 3–8 illustrate progressive steps in forming the internal hydroformed reinforcements in the hydroformed structural member.

DETAILED DESCRIPTION OF THE PREFERRED EMBODIMENTS

Figure 7:
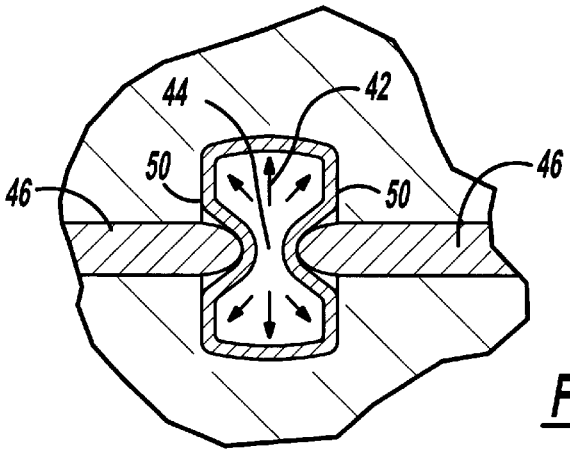
Figure 8:
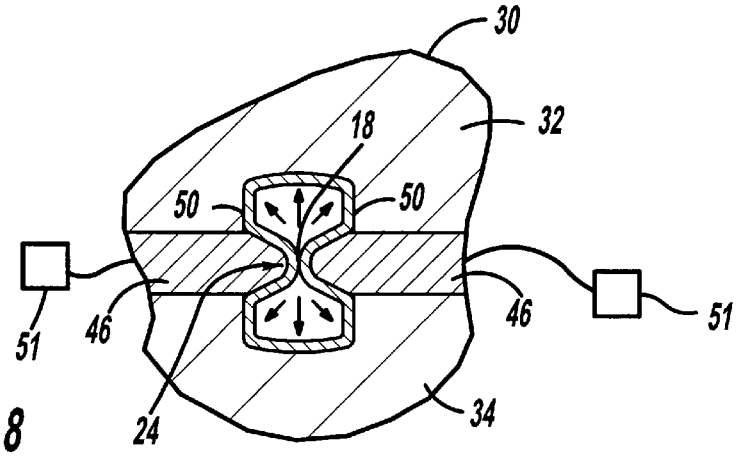

The following description of the preferred embodiment is merely exemplary in nature and is in no way intended to limit the invention, its application, or uses. For example, the techniques disclosed herein may have utility in forming a wide variety of different hydroformed parts.

Referring to the drawings, a hydroformed structural member 10, and a method of making the same, is provided for use in various load bearing applications. Hydroformed structural member 10 is hydroformed from a single, continuous, tubular member. As best seen in FIG. 1, hydroformed structural member 10 includes a plurality of depressions or indentations 12 disposed along opposing sidewalls 14 of hydroformed structural member 10. Each of the plurality of indentations 12 is shown generally having an inwardly projecting, arcuate bulge 16.

As best seen in FIG. 2, the plurality of indentations 12 are positioned along hydroformed structural member 10 to define generally opposing pairs of indentations 12. Each pair of indentations 12 are positioned along hydroformed structural member 10 to provided crash energy management and further provide additional sectional stiffness as needed for localized loading. Preferably, each pair of indentations 12 are secured together at a point of contact 18 to provide further structural integrity, although this is not required. This point of contact 18, as seen in FIG. 2, preferably occurs at an internal apex 20 of inwardly projecting, arcuate bulge 16. Each pair of indentations 12 may be secured at point of contact 18 via a weld 22. However, it should be appreciated that each pair of indentations 12 may be secured together by any known method that provides a reliable connection. Each pair of indentations 12 defines an internal hydroformed reinforcement 24 within hydroformed structural member 10.

According to a preferred method of forming hydroformed structural member 10 and internal hydroformed reinforcements 24, a straight tube 26 having uniform wall thickness is first provided. Generally, straight tubes are readily available in the marketplace to facilitate mass production of hydroformed structural member 10 with internal hydroformed reinforcements 24.

Preferably, as seen in FIGS. 3–4, straight tube 26 is preformed into a generally oblong member 28 having a slightly reduced cross-sectional width A relative to an end width B. It should be appreciated, however, that straight tube 26 may be simply hydroformed, without the need to preform the member, depending upon the required physical and mechanical characteristics of the application.

During the hydroforming process as seen in FIGS. 5–8, oblong member 28 is first disposed in a hydroforming die 30. Hydroforming die 30 generally includes an upper die member 32 and a lower die member 34. Upper die member 32 and lower die member 34 include opposing surfaces 36, 38 respectively. Opposed surfaces 36 and 38 are contoured, aligned, and spaced to define a tooling cavity 40. Hydroforming die 30 further includes a plurality of fluid inlet ports (not shown) adapted to deliver a hydraulic fluid 42 (FIG. 7) under extreme pressure, typically in the range of 10,000 to 30,000 psi, to an interior volume 44 of oblong member 28.

As best seen in FIGS. 5–8, hydroforming die 30 further includes a plurality of rams 46. Rams 46 are each adapted to be disposed between upper die member 32 and lower die member 34 of hydroforming die 30. However, it should be appreciated that rams 46 may be disposed in any orientation in hydroforming die 30. Rams 46 are each selectively actuated or driven to extend past an internal surface 48 of tooling cavity 40 and against opposing sidewalls 50 of oblong member 28.

During manufacturing, oblong member 28 is placed in tooling cavity 40 of hydroforming die 30. Oblong member 28 generally follows the contour shape of tooling cavity 40 of hydroforming die 30, yet is smaller in width and height to accommodate hydroforming. Oblong member 28 is then enclosed within hydroforming die 30 as seen in FIG. 5. The slightly reduced cross-sectional dimension of oblong member 28 relative to tooling cavity 40 of hydroforming die 30 defines a gap 52 generally surrounding oblong member 28. Gap 52 generally represents the difference in cross-sectional dimensions between the current oblong member and the final preferred member. The hydraulic fluid injectors are then coupled to the ends of oblong member 28 to provide a fluid seal between interior volume 44 of oblong member 28 and a hydraulic fluid pressure source (not shown).

Referring to FIG. 6, rams 46 are then actuated and/or driven against sidewalls 50 of oblong member 28. The force of rams 46 driving against sidewalls 50 of oblong member 28 forces sidewalls 50 to inwardly deform in response thereto. It should be appreciated that the first position of rams 46 may be such that the rams allow movement of oblong member 28 within tooling cavity 40 to enable proper positioning of oblong member 28 to be achieved automatically during hydroforming. It should further be appreciated that the initial position of rams 46 further enables localized stretching of oblong member 28 during the hydroforming process. By way of example, following the actuation of rams 46, sidewalls 50 define a cross-sectional dimension C, which is smaller than cross-sectional dimension A.

Referring to FIG. 7, hydraulic fluid 42 is then introduced into interior volume 44 of oblong member 28 such that oblong member 28 expands to closely conform to the shape of tooling cavity 40 of hydroforming die 30 and to the shape of rams 46. Pressurized hydraulic fluid 42 forces sidewalls 50 outward to form the preferred profile of hydroformed structural member 10. Finally, referring to FIG. 8, rams 46 are further actuated and/or driven against sidewalls 50 of oblong member 28 during continued application of hydraulic fluid 42. Preferably, rams 46 are driven until sidewalls 50 of oblong member 28 are substantially in contact, thereby defining point of contact 18. This method thereby forms internal hydroformed reinforcements 24.

It is anticipated that rams 46 may be welding electrodes to enable point of contact 18 to be welded while member 28 is disposed in hydroforming die 30. To this end, each ram 46 is coupled to a welding device 51 (FIG. 8) that is capable of welding member 28.

Figure 9:
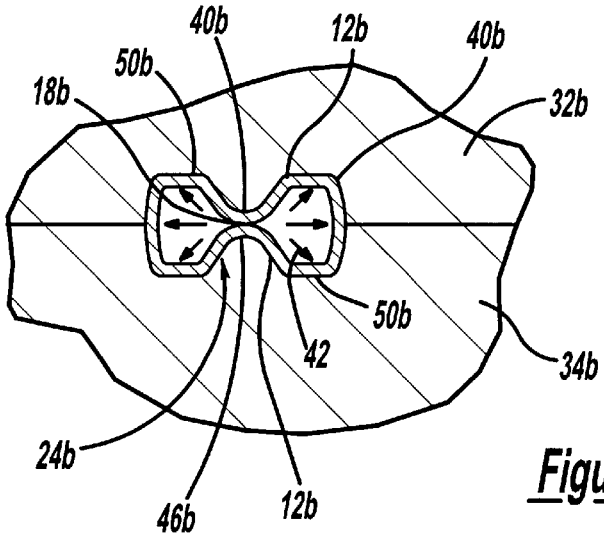
FIG. 9 illustrates an alternative embodiment of the hydroforming die.

Alternatively, as seen in FIG. 9, rams **46*b* may be fixedly secured or integrally formed with upper die cavity 32*b* and lower die cavity 34*b*. During manufacturing, internal hydroformed reinforcement 24*b* are initially formed during closure of upper die cavity 32*b* and lower die cavity 34*b*. Subsequent introduction of hydraulic fluid 42 forces sidewalls 50*b* to closely conform to tooling cavity 40*b*. Such arrangement simplifies the hydroforming die. Preferably, a point of contact 18*b* is achieved to facilitate fastening of indentations 12*b***.

Referring to FIG. 2, internal hydroformed reinforcement may then be secured together via weld 22 to provide improved structural loading and integrity. Moreover, additional external supports, such as a coverplate 54 and/or a bracket 56 may then be fastened to an exterior portion 58 of hydroformed structural member 10. Preferably, coverplate 54 and bracket 56 are secured to hydroformed structural member 10 at a position directly over each of the plurality of indentations 12 to provide further improved structural integrity.

It should be appreciated that the hydroformed structural member having internal hydroformed reinforcements of the present invention provides a unique and novel member for use in load bearing applications, which is simply and conveniently formed in a single hydroforming process. Moreover, the hydroformed section is essentially intact during the complete hydroforming process, thus ensuring dimensional integrity. Distortion due to welding on the side plates can be minimized by welding them simultaneously.

The invention being thus described, it will be obvious that the same may be varied in many ways. Such variations are not to be regarded as a departure from the spirit and scope of the invention. Such variations or modifications, as would be obvious to one skilled in the art, are intended to be included within the scope of the following claims.

What is claimed is:

1. A method for hydroforming internal reinforcements in a member, said method comprising:

providing a die having a tooling cavity;

providing a pair of opposing rams disposed in said tooling cavity;

providing a tubular member;

enclosing said tubular member within said tooling cavity;

driving said pair of opposing rams against opposing sides of said tubular member to form a pair of opposing indentations therein;

applying fluid pressure within said tubular member, said fluid pressure causing the walls of said tubular member to closely conform to the shape of said tooling cavity and said pair of opposing rams;

maintaining said fluid pressure within said tubular member; and further driving said pair of opposing rams against said opposing sidewalls of said tubular member to further form said pair of opposing indentations dimension in said tubular member, said pair of opposing indentations being substantially adjacent thereby generally defining a point of contact between said opposing sidewalls.

2. The method according to claim 1, further comprising the step of:

welding said opposing sidewalls of said tubular member together generally at said point of contact.

3. The method according to claim 2 wherein said welding is performed while said tubular member is enclosed in said tooling cavity.

4. The method according to claim 1, further comprising the step of:

preforming said tubular member to a desired shape prior to enclosing said tubular member within said tooling cavity.

5. The method according to claim 1, further comprising the step of:

securing an external member substantially over each of said indentations.

6. The method according to claim 5 wherein said external member is a bracket.

7. A method for hydroforming internal reinforcements in a member, said method comprising:

providing a die having a tooling cavity;

providing a pair of opposing rams disposed in said tooling cavity, said pair of opposing rams being selectively movable relative to said tooling cavity;

providing a tubular member;

enclosing said tubular member within said tooling cavity;

driving said pair of opposing rams against opposing sides of said tubular member to form a pair of opposing indentations therein; and applying fluid pressure within said tubular member, said fluid pressure causing the walls of said tubular member to closely conform to the shape of said tooling cavity and said pair of opposing rams.

8. The method according to claim 7, further comprising:

maintaining said fluid pressure within said tubular member; and further driving said pair of opposing rams against said opposing sidewalls of said tubular member to further form said pair of opposing indentations dimension in said tubular member, said pair of opposing indentations being substantially adjacent thereby generally defining a point of contact between said opposing sidewalls.

9. The method according to claim 7, further comprising:

welding said opposing sidewalls of said tubular member together generally at said point of contact.

10. The method according to claim 9 wherein said welding is performed while said tubular member is enclosed in said tooling cavity.

11. The method according to claim 7, further comprisin:

preforming said tubular member to a desired shape prior to enclosing said tubular member within said tooling cavity.

12. The method according to claim 7, further comprising:

securing an external member substantially over each of said indentations.

13. The method according to claim 12 wherein said external member is a bracket.

14. A method for hydroforming internal reinforcements in a member, said method comprising the steps of:

providing a die having a tooling cavity;

providing a pair of opposing rams disposed in said tooling cavity;

enclosing a tubular member within said tooling cavity, said tubular member having opposing sidewalls being separated by a first distance;

driving said pair of opposing rams against said opposing sidewalls of said tubular member to form a pair of opposing depressions in said tubular member, said pair of opposing depressions being separated by a second distance, wherein said second distance is shorter than said first distance;

applying fluid pressure within said tubular member, said fluid pressure causing the walls of said tubular member to closely conform to the shape of said tooling cavity and said pair of opposing rams; and further driving said pair of opposing rams against said opposing sidewalls of said tubular member to further form said pair of opposing depressions dimension in said tubular member, said pair of opposing depressions being separated by a third distance generally defining a point of contact between said opposing sidewalls.

15. The method according to claim 14, further comprising the steps of:

maintaining said fluid pressure within said tubular member during said step of further driving said pair of opposing rams against said opposing sidewalls of said tubular member.

16. The method according to claim 15, further comprising the step of:

welding said opposing sidewalls of said tubular member together generally at said point of contact while said tubular member is enclosed in said tooling cavity.

17. The method according to claim 14 wherein said pair of opposing rams is selectively movable relative to said tooling cavity.

18. The method according to claim 14 wherein said pair of opposing rams is fixedly disposed within said tooling cavity.

19. The method according to claim 14, further comprising the step of:

preforming said tubular member to a desired shape prior to enclosing said tubular member within said tooling cavity.

20. The method according to claim 14, further comprising the step of:

securing an external member substantially over each of said depressions.

21. A hydroformed rail for improved structural capability, said rail comprising:

a generally unitary, hydroformed member having a pair of opposing sidewalls; and an inwardly projecting portion hydroformed in each of said pair of opposing sidewalls, said inwardly projecting portions being opposingly spaced and generally adjacent to each other for improved structural capability, wherein said inwardly projecting portions are fixedly interconnected.

22. The hydroformed rail according to claim 21, further comprising:

an external member being secured to an exterior surface of each of said sidewalls over said inwardly projecting portion.

23. The hydroformed rail according to claim 22 wherein said external member is a bracket.

24. A hydroformed rail for improved structural capability, said rail comprising:

a generally unitary, hydroformed member having a pair of opposing sidewalls;

an inwardly projecting portion hydroformed in each of said pair of opposing sidewalls, said inwardly projecting portions being opposingly spaced and generally adjacent to each other for improved structural capability; and an external member being secured to an exterior surface of each of said sidewalls over said inwardly projecting portion.

25. The hydroformed rail according to claim 24 wherein said external member is a bracket.

* * * * *